United States Patent [19]

Hendry

[11] 4,181,126

[45] Jan. 1, 1980

[54] CRYOGENIC, UNDERWATER-BREATHING APPARATUS

[76] Inventor: Stephen M. Hendry, 7526 Jerez Ct., No. 3, Carlsbad, Calif. 92008

[21] Appl. No.: 871,751

[22] Filed: Jan. 23, 1978

[51] Int. Cl.[2] ..... A62B 7/06; B63C 11/22

[52] U.S. Cl. ..... 128/201.21; 128/205.22

[58] Field of Search ..... 128/142 R, 142 G, 142.2, 128/142.3, 142.4, 142.5, 142.7, 145 R147, 188, 203, 204, 209, 210; 62/52

[56] References Cited

U.S. PATENT DOCUMENTS

| | | | |
|---|---|---|---|
| 3,368,556 | 2/1968 | Jensen et al. | 62/52 |
| 3,524,444 | 8/1970 | Ellard et al. | 128/142 R |
| 3,941,124 | 3/1976 | Rodewald et al. | 128/142 G |

*Primary Examiner*—Henry J. Recla
*Attorney, Agent, or Firm*—Francis X. LoJacono

[57] ABSTRACT

A cryogenic, submersible, synthetic air-breathing system which provides the diver with a proper breathing atmosphere, including provisions for a water-jet propulsion unit to propel the diver to an extended underwater range. The system utilizes liquid oxygen and liquid nitrogen, each stored in respective tanks, whereby the gases pass through a series of heat exchangers, regulators, check valves and a slider valve into which the regulated gases enter a mixing chamber wherein breathable air is generated therein, and then delivered to the diver's face mask—an unmixed portion of the gas being used as the means to power a conventional air motor which, in turn, powers an underwater jet engine.

11 Claims, 4 Drawing Figures

REGULATOR & MOUTHPIECE
$N_2$
$O_2$

CRYOGENIC, UNDERWATER-BREATHING APPARATUS

BACKGROUND OF THE INVENTION

1. Field of the Invention

This invention relates generally to underwater breathing apparatuses, and more particularly to a cryogenic breathing apparatus that utilizes liquid nitrogen and liquid oxygen mixed under controlled conditions to supply air to the diver.

2. Description of the Prior Art

Throughout the last two decades, several advances have been made in the field of scuba diving (such as closed-loop recycling systems and advanced air-mixing units), but these systems are highly expensive and relatively unavailable to the average diver. By using the conventional compressed-air systems, scuba enthusiastics are handicapped by limited air supply and heavy, cumbersome scuba packs.

Since the majority of sport divers are without boats, they must make exhausting surf and/or long surface swims before reaching their desired diving areas. The typical diver is a novice, fair-weathered, weekend-type sport enthusiast, who frequently overestimates his/her physical condition, and is likely to exceed his endurance capabilities. The fatalities due to pure exhaustion are astronomical among these divers.

The earth's unpolluted atmosphere consists of approximately 80% nitrogen and 20% oxygen, but an optimum diving mixture—down to 130 feet underwater—consists of 60% nitrogen and 40% oxygen. If a diver desires to submerge at depths lower than 130 feet, or stay underwater longer than the standard diving charts permit, a different breathing apparatus should be applied. Such an apparatus will not fail at depths lower than 130 feet, but inhalation will become difficult to impossible.

As examples of the prior art, one may refer to the following issued U.S. Pat. Nos. 2,915,059—an autonomous closed-cycle diving apparatus, which includes a bellows-like pressure-responsive control unit which forms a basic part of the apparatus; 3,333,583—which relates to an artificial gill and more particularly to an underwater respiration and air-purifying device; 3,351,089—a control valve for diving apparatus; 3,483,865—relates to a portable tank assembly for a breathing apparatus; 3,898,978—relates to a self-contained, portable, breathing-gas-heating system; 3,971,372—an oxygen generator by means of electrolysis for underwater swimming; and 4,016,878—which is a heater and humidifier for use with a breathing mask.

SUMMARY OF THE INVENTION

The present invention comprises two cylindrically shaped tanks, known as Dewars, one containing 4 liters of liquid oxygen and the other 6 liters of liquid nitrogen, each having its respective boil-off rates and temperatures. Each tank includes flexible, thermal-insulated lines feeding to their respective heat exchangers or expansion chambers. The gases leaving the heat exchangers/gas expansion chambers are routed by thermal-conductive lines to a pressure-differential shuttle valve. Disposed between each exchanger and the shuttle valve is a low pressure regulator whereby the gases leaving the regulators are routed through the shuttle valve. A second line is also provided whereby gas pressure is supplied to an air motor by way of a manually operated, pressure-control valve which allows the diver to vary the supply of gas delivered to the air motor. A lined cable connected to the diver's trigger-control mechanism operates the air-motor speed regulator.

The pressure differential shuttle valve is a safety feature to prevent the diver from inadvertently breathing unmixed gas. Thus, the gases are fed from the shuttle valve directly into a mixing chamber which basically defines a submersible carburetor for the nitrogen and oxygen. Attached to the exit side of the chamber is a one-way check valve to prevent backflow from the emergency priority valve.

Thus, the pressure-differential shuttle valve serves two purposes; one, it is a check-and-balance system for the two 120 psi regulators; two, it is a safety feature to prevent the diver from breathing only unmixed gas. Accordingly with both gases being of equal temperature and pressure, they can be mixed to create a synthetic breathing atmosphere through the mixer chamber.

To ensure the safety of the diver, there is provided an emergency priority valve which operates either manually or automatically to activate a back-up air bottle, whereby emergency air can be instantly applied to the diver upon malfunctioning of the basic system. The emergency air bottle is connected to the emergency priority valve which discharges air directly into any known suitable mouthpiece.

OBJECTS AND ADVANTAGES OF THE INVENTION

The present invention has for an important object a provision wherein an underwater-breathing apparatus includes a controlled mixing chamber of liquid oxygen and liquid nitrogen, whereby the combination thereof supplies a proper breathing atmosphere for use under deep diving conditions heretofore not possible in the art.

It is another object of the invention to provide a cryogenic underwater-breathing apparatus that is capable of having operably attached thereto a jet-powered propulsion unit.

It is still another object of the invention to provide a unique underwater-breathing apparatus that not only allows the diver greater amounts of diving air, but also provides an inexpensive, lightweight unit which has the capabilities to propel the diver to an extended range via an air motor and underwater jet pump.

It is a further object of the invention to provide an apparatus of this type wherein the cryogenic liquid gases supplied by this system are readily available and considerably less expensive per cubic feet than compressed air.

A still further object of the present invention is to provide an apparatus of this character that includes inherent safety back-up elements to reduce the risk of a diver harming himself by staying underwater too long.

It is still a further object of the invention to provide an apparatus of this character that is easy to service and maintain.

Still another object of the invention is to provide an apparatus of this type that is simple and rugged in construction, and designed to be readily suitable for support by the individual diver.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
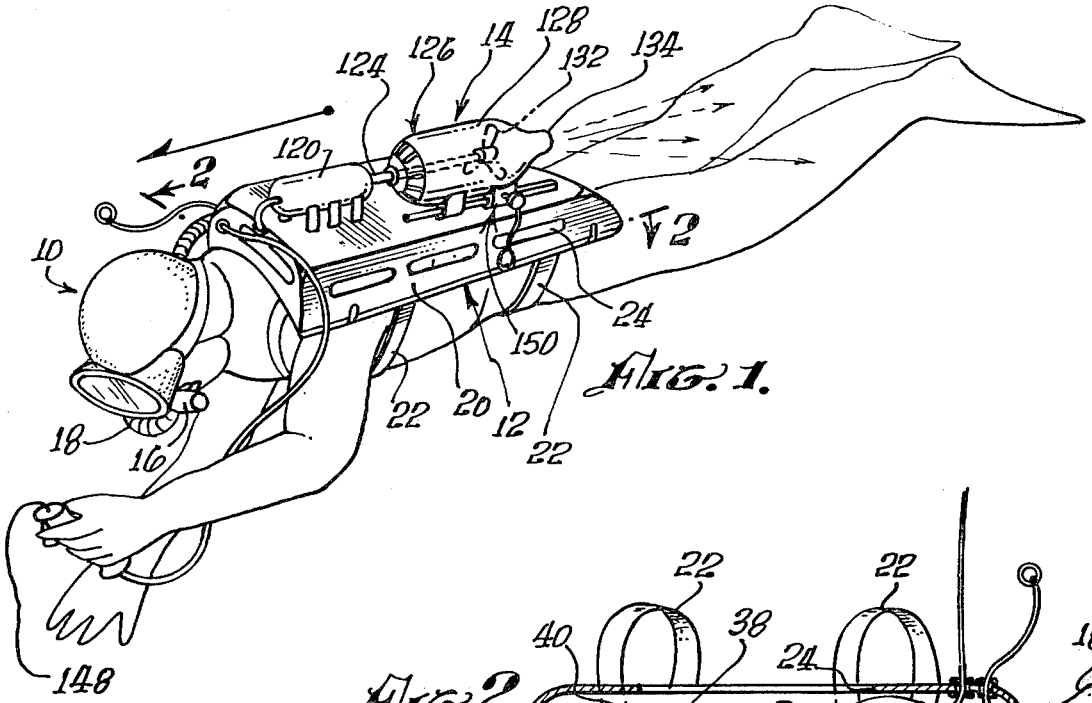
FIG. 1 is a pictorial view of a diver having the present cryogenic underwater-breathing apparatus attached to his back, together with a jet-powered propulsion unit.

Referring more particularly to FIG. 1, there is shown a diver, generally indicated at 10, having strapped to his back the present invention, a cryogenic underwater-breathing apparatus, indicated at 12, including a jet-powered propulsion unit, designated at 14.

As can be seen in FIG. 1, the diver has positioned in his mouth a mouthpiece 16, this mouthpiece being any suitable, known breathing means which generally includes its own regulator, the mouthpiece being operably connected to apparatus 12 by a discharge line or hose 18. Line 18 passes through backpack housing 20. Housing 20 can be constructed in any suitably designed configuration, wherein the apparatus 12 is mounted. It is contemplated that housing 20 will be made of a lightweight plastic material suitable for use underwater and under extreme temperatures. The backpack is also provided with harness straps 22 of any well known type, so as to be adjustable to each individual user.

It is necessary for the proper operation of this apparatus that the interior elements be totally exposed to direct contact with or submergence in the water. Thus, in order to accomplish this, the housing 20 is provided with several enlarged openings 24 whereby water is allowed to freely flow therethrough.

Figure 2:
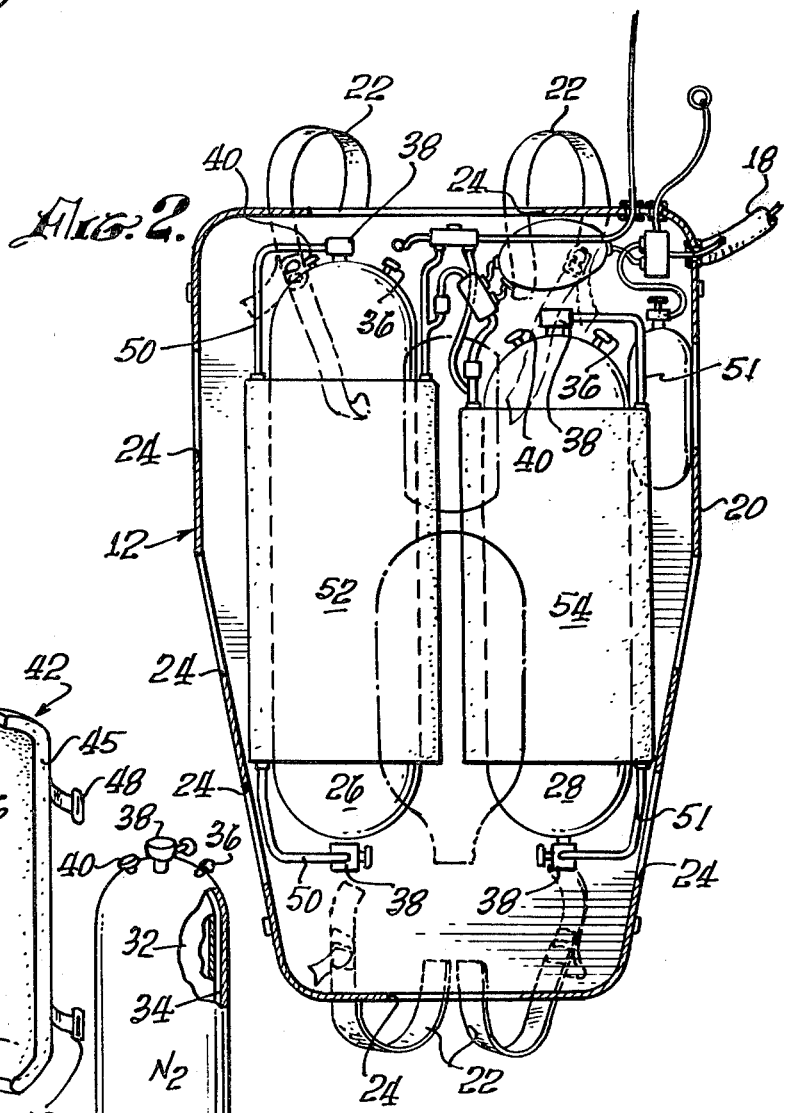
FIG. 2 is an enlarged cross-sectional view taken substantially along line 2—2 of FIG. 1 wherein the interior of the housing is cut away to illustrate the arrangement of the breathing system disposed therein.
Figure 4:
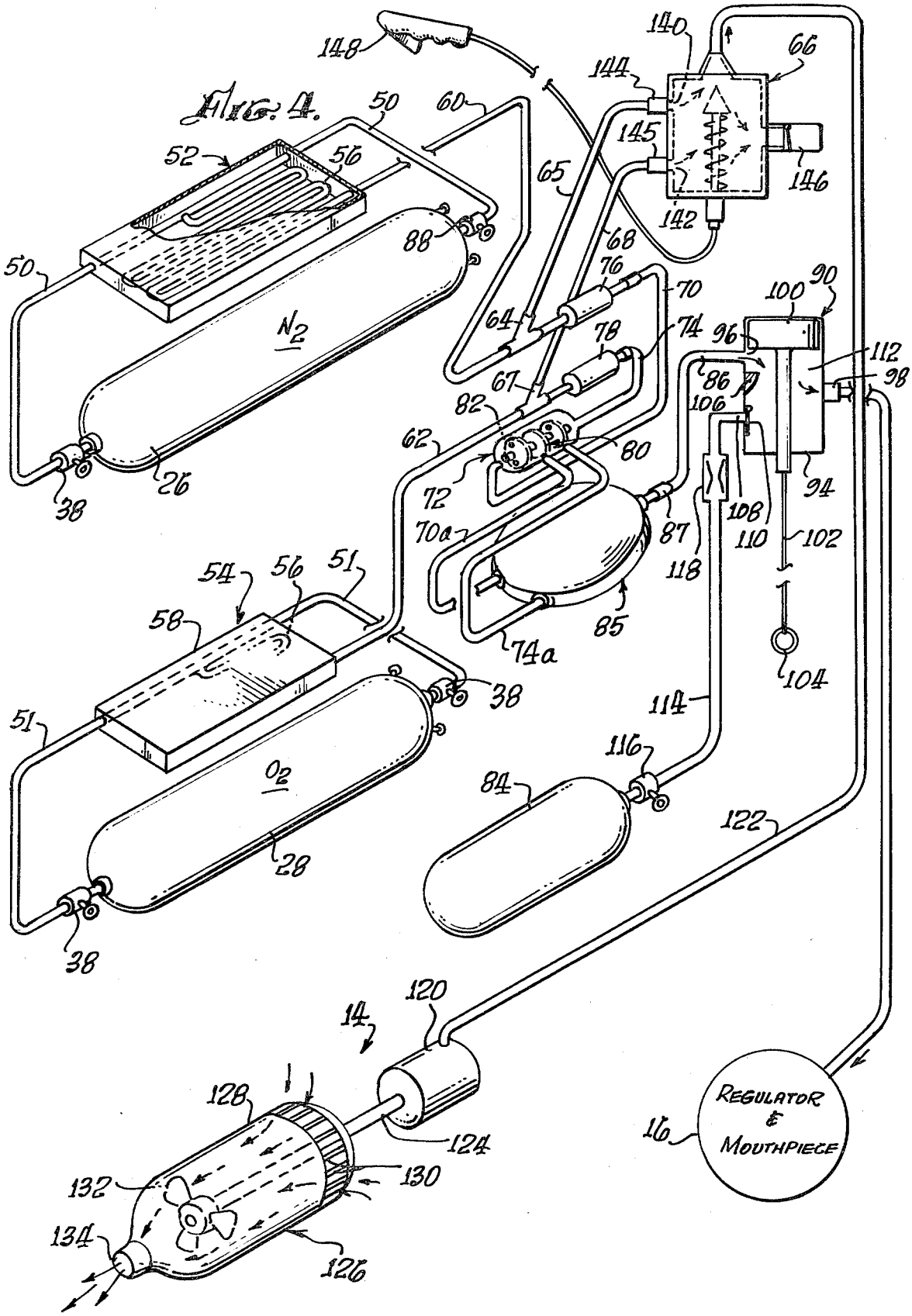
FIG. 4 is a diagrammatic showing of the overall, cryogenic breathing apparatus and the interconnected power unit.

The cryogenic, underwater-breathing system is more readily seen in FIGS. 2 and 4, in which the system comprises a pair of cryogenic, high-pressure, cylindrically-shaped tanks—otherwise known as Dewars. The tank indicated at 26 represents a gas-storage vessel for liquid nitrogen ($N_2$) and tank 28 has stored therein liquid oxygen ($O_2$). It is contemplated that nitrogen tank 26 will provide 6 liters of gas, and tank 28 will provide for storage of 4 liters of liquid oxygen.

Figure 3:
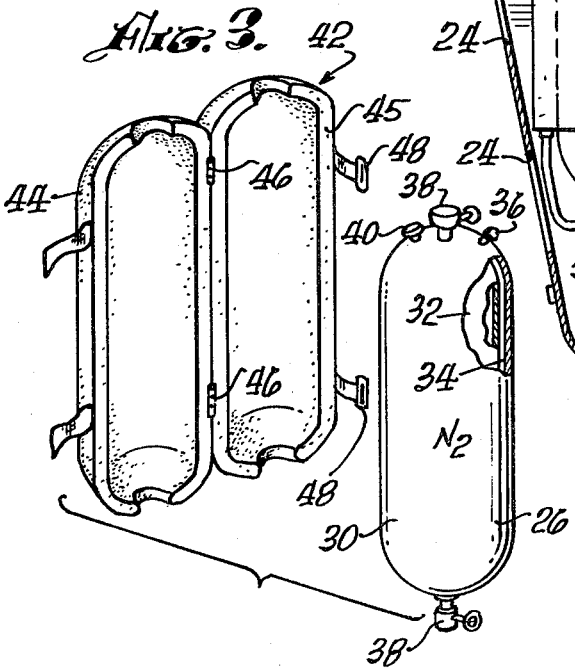
FIG. 3 is an exploded, perspective view of a cryogenic tank and its associated insulating cover.

Each tank 26 and 28 is constructed having an outer (perferably stainless steel) casing 30 in which is disposed a center core or container 32 wherein a space 34 is defined therebetween—thus establishing a vacuum chamber. (This is clearly shown in FIG. 3.) In addition, each tank includes a vacuum-release valve 36, by which the vacuum therein is released to allow the diver to retain the liquids at optimum efficiency until ready for use. Opening of vacuum-release valve 36 destroys the inside vacuum chamber 34, and permits a rapid gas boil-off rate which is required during the operation of the apparatus. Prior to refilling, the vacuum chamber 34 is recharged and sealed. The Dewars 26 and 28 are then refilled by removing the valve fittings 38 and connecting the appropriate refill lines (not shown). To aid in the refilling, center container 32 is provided with a vent valve 40.

After the tanks are fully charged with their respective gases ($N_2$) and ($O_2$)—and prior to being installed in the operating system—an insulating jacket, generally indicated at 42, is secured about the outer casing 30, the jacket 42 having two half sections 44 and 45 hinged together at 46 so as to encapsulate the tanks, the half sections being secured by straps 48.

Each end of the central core or container 32 is provided with valve fittings 38 located at opposite ends of each tank 26 and 28. A pair of flexible, thermal-insulated lines 50 and 51 is connected to respective tanks, and extends to respective heat-exchanger means, wherein the heat-exchanger means also defines an expansion chamber, said means being indicated generally at 52 and 54, respectively. Thus, lines 50 enter at opposite ends of heat exchanger 52, and lines 51 enter heat exchanger 54 at opposite ends, as seen in FIGS. 2 and 4.

It should be noted that various forms of heat-exchanger means can be provided, but are shown herein in the simple form of a continuous conduit 56 disposed in a sealed housing 58.

Once tanks 26 and 28 are connected into the system, the styrofoam jacket is removed to allow the tanks to be submerged in direct contact with the water (water is much more thermally conductive than the atmosphere), and thus creates a rapid boil-off of both gases.

Housing 58 of both heat exchangers 52 and 54 are preferably made of stainless steel sealed to provide a vacuum container, wherein the vacuum spacing therein keeps the container or housing 58 from becoming extremely cold, and prevents possible freeze burns as the gas passes through the chamber. Thus, as the gas leaves the exchanger, it has been increasesd in temperature to above-freezing, and, likewise, the pressure has increased proportionately.

Connected to the discharge end of the heat exchangers 52 and 54 are thermal-conductive lines 60 and 62, respectively. Line 60 branches off at fitting 64, whereby line 65 extends to a manual air-motor-pressure-control regulator means, generally indicated at 66; and line 62 branches off similarly at fitting 67 having line 68 also connected to control regulator 66. Control-regulator means will hereinafter be described in the operation of the jet-powered propulsion unit 14.

Accordingly, line 70 is also connected to fitting 64 which allows gas ($N_2$) from tank 26 to flow into shuttle-valve means 72; and line 74 connected to fitting 67 is coupled to shuttle valve means 72 as well—thus, ($O_2$) gas flows from tank 28 into valve 72. Disposed within respective lines 70 and 74 are two low-pressure regulators 76 and 78 that are adjustable to predetermined valves. The temperature and pressure of each gas leaving regulators 76 and 78 must be equal before entering shuttle valve 72, the pressure approximately 120 psi. Thus, the regulators equalize the oxygen and nitrogen pressures to enable proper mixture.

Various types of shuttle-valve means can be suitably used, wherein the purpose of such a shuttle valve is provided as a safety feature to prevent the diver from inadvertently breathing unmixed gases. Each gas ($N_2$ and $O_2$) enter from opposite ends of the shuttle valve 72, and exists through respective lines 70*a* and 74*a*. Inside the cylinder of valve 72 is a spring-centered shuttle mechanism 80 which consists of three circular piston members 82, with the outer two having vent holes to allow gas to pass therethrough. The center piston member fits tightly inside the cylinder and serves as a moving force for the shuttle mechanism, the pistons being commonly attached to move together. Thus, the shuttle mechanism is balanced in the centered position by spring means located therein. With each gas pressure equal, the shuttle mechanism will remain centered, allowing each gas to exit its respective outlets into lines 70*a* and 74*a*. If a pressure differential above ±5 psi occurs, the shuttle mechanism will become unbalanced and slide away from the side of greater pressure. When the shuttle mechanism travels away from the centered position, both gas outlets become blocked by the center and respective outer piston. This will secure the breathing apparatus and prevent the diver from breathing a disproportional amount of gases. When a pressure loss is thus detected further downstream, the back-up-air-bottle system 84 is actuated. The operation of back-up-air bottle 84 will be later described. Thus, the pressure-differential shuttle valve serves two purposes—as a safety feature, and as a check-and-balance system for regulators 76 and 78.

Accordingly, as the gases leave valve 72, they are equal in temperature and pressure and, thus, can be mixed to create a synthetic breathing atmosphere through the mixer chamber 85, the mixer chamber being basically a submersible carburetor for the nitrogen and oxygen gases. The mixed gases exit into line 86 which includes a one-way check valve 87. Mixer chamber 85 is provided with a sufficient size to act as an air reservoir for the diver, in the event an unusual amount of air is required instantaneously.

Line 86 is connected to an emergency priority valve, indicated at 90, which can be operated either manually or automatically to activate the back-up-air-bottle system 84. Hence, the mixed gas of $N_2$ and $O_2$ is passed into emergency valve 90, and is discharged therefrom through line 92. Line 92 is then attached to a breathing mouthpiece 16. There are several types of known mouthpieces which most can be used with the present invention.

The emergency priority valve 90 as shown in FIG. 4 is one example thereof, and comprises a cylindrically shaped housing 94 having an inlet opening 96 and an outlet opening 98. Line 86 is connected to inlet 96, and line 92 is connected to outlet 98. Slidably disposed within housing 94 is a piston 100 attached to a manually operated cable 102. In a normal operation, the piston 100 is set flush to the upper end of the cylindrical housing 94, allowing the gas to freely flow in and out of the housing. This piston enables the diver, at his choice, to manually shut off the gas flow from chamber 85, if a suspected bad-air source is detected. This is accomplished by pulling ring 104 which is attached to cable 102—which, in turn, is secured to piston 100. When inlet 96 is to be closed, cable 102 is pulled and piston 100 slides to a position adjacent inlet 96, and is stopped against shoulder 106—thus leaving outlet opening free to communicate with auxiliary inlet 108 which is controlled by flap valve 110. At this time, the pressure in bottle 84 overcomes flap valve 110, allowing air stored therein to pass into and through valve chamber 112, and into line 92 and mouthpiece 16—bottle 84 being connected to auxiliary opening 108 by air conduit line 114. Bottle 84 also includes regulator 116 so as to control air flow therefrom.

As the pressurized air passes through line 114, it also is passed through an alarm-indicator means, such as a harmonic, internal whistle device 118, whereby sound is produced by the forced air passing therethrough. The back-up-supply bottle 84 is a small, conventional, compressed-air bottle with approximately 90 psi regulator 116 attached to its outlet. It provides the diver with a sufficient air supply for a safe ascent from depths up to 200 feet.

In order for the back-up air to be automatically actuated, its pressure is regulated to 90 psi; and its entrance to the emergency priority valve 90 is controlled by the 90 psi relief or flap valve 110. Since the air pressure of the apparatus is approximately 120 psi as it enters inlet 96 of valve 90, flap valve 110 will remain closed, thus retaining the back-up air. But, once the apparatus gas-flow pressure drops below 90 psi, the flap or relief valve 110 unseats—allowing the 90 psi back-up air to enter into valve chamber 112.

Accordingly, the 90 psi relief valve 110 operates whenever one of the following three conditions occurs:

(1) The air in the apparatus is secured by the pressure-differential shuttle valve 72;

(2) The manually operated shut-off piston 100 is moved by pulling ring 104;

(3) There is a very large demand for air at the mouthpiece regulator 16 which temporarily depletes the reserve air in the mixer chamber 85.

Referring now to the jet-powered propulsion unit 14, as seen in FIGS. 1 and 4, there is shown an air motor 120 having a pressure line 122 connected to control regulator 66. Motor shaft 124 interconnects air motor 120 and propulsion unit 126. Propulsion unit 126 comprises a housing 128 having apertures 130 disposed in the forward portion thereof, to allow water to be drawn into housing 128 by propeller 132 which is secured to shaft 124. As the propeller rotates, water enters apertures 130 and is forced out of discharge venturi 134.

Air pressure is received by motor 120 through lines 65 and 68 which connect to respective inlets 140 and 142 of the air-motor, pressure-control means 66. Located within each inlet 140 and 142 is a separate pressure regulator 144 and 145. Regulators 144 and 145 assure respective income pressures to be above 150 psi. The control means 66 also serves as a pressure-relief system for both tanks and heat exchangers, wherein a 200 psi pressure-relief valve 146 is located along the side of control means 66. Control means 66 can be any known suitable unit that can be operated by a trigger means such as 148 operably attached to control means 66, as shown in FIG. 4. The hand-held trigger means 148, when squeezed, will allow the diver to vary the supply of gases delivered to the air motor.

Mounting means 150 is provided to releasably mount propulsion unit 120 which defines the water-jet pump. This is shown in FIG. 1. When the jet pump 126 is to be removed, shaft 124 is arranged to be separated from air motor 120. Thus, this apparatus can be operated with or without the propulsion system.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A cryogenic, underwater-breathing apparatus comprising:

a first tank having liquid nitrogen stored therein;

a second tank having liquid oxygen stored therein;

a pair of heat exchangers defining a gas-expansion chamber, each heat exchanger being connected to respective first and second tanks of liquid nitrogen and oxygen, whereby said gases therefrom pass through said respective heat exchangers;

a gas-mixing chamber connected to both of said heat exchangers wherein said nitrogen and oxygen are mixed together as breathable air under a predetermined pressure;

a shuttle-valve means operably interposed between said heat exchangers and said mixing chamber, whereby gases under equal pressure from said tanks are allowed to flow through said shuttle valve means under a balanced condition, and whereby gases under unequal pressure from said tanks cause said shuttle-valve to become unbalanced, preventing gases from flowing therethrough and entering said mixing chamber;

a pair of low-pressure regulator means, each being operably interposed between respective heat exchangers and said shuttle valve means, whereby the gas pressure from each tank is equalized prior to entering said shuttle valve; and a mouthpiece regulator operably interconnected to said mixing chamber so as to receive the mixed gases from said mixing chamber for breathing by the diver while submerged underwater.

2. A breathing apparatus as recited in claim 1, wherein said apparatus includes:

an emergency, priority-valve means interposed between said mixing chamber and said mouthpiece regulator, whereby said gas from said mixing chamber can be prevented from reaching said mouthpiece; and an emergency air bottle connected to said emergency, priority-valve means to supply air through said priority valve when said valve is actuated to a closed mode, or when said gas from said mixing chamber drops below a predetermined pressure.

3. A breathing apparatus as recited in claim 2, wherein the connection between said air bottle and said priority valve includes a relief-valve flap arranged to open when the gas pressure within said priority valve drops below a predetermined pressure.

4. A breathing apparatus as recited in claim 3, wherein said apparatus includes a jet-powered propulsion unit operably connected and interposed between said heat exchangers and said low-pressure regulator means whereby gas pressure is received from said exchangers to drive said propulsion unit.

5. A breathing apparatus as recited in claim 4, wherein said jet-powered propulsion unit comprises:

an air-motor, pressure-control means arranged to receive gas from at least one of said tanks under predetermined pressure, and to discharge gas therefrom under variable pressures;

an air motor operably arranged to receive the variable pressure from said pressure-control means;

a jet pump driven by said air motor;

means for releasably attaching said jet pump to said apparatus; and means for manually controlling said air-motor, pressure-control means whereby the discharged gas pressure is regulated to control the speed of said air motor.

6. A breathing apparatus as recited in claim 5, wherein said air-motor-pressure-control means includes:

a pair of inlets;

a discharge outlet;

a pair of pressure regulators, each being disposed in respective intlets to regulate the flow of nitrogen and oxygen gases entering said pressure-control means; and a pressure-relief valve.

7. A breathing apparatus as recited in claim 3, wherein an alarm-indicator means is interposed between said air bottle and said priority-valve means, to indicate when said air from said bottle is being used.

8. A breathing apparatus as recited in claim 3, wherein said apparatus includes means to manually operate said priority-valve means, and is operably mounted to said priority means.

9. A breathing apparatus as recited in claim 8, wherein a one-way check valve is positioned between said mixing chamber and said priority valve, to prevent a back flow of gas from said priority valve.

10. A breathing apparatus as recited in claim 9, wherein the pressure from said emergency bottle is regulated to approximately 90 psi and controlled by said relief-valve flap; and wherein the pressure entering said priority valve from said mixing chamber is approximately 120 psi, said relief valve flap operates when said pressure from said mixing chamber drops below 90 psi.

11. A breathing apparatus as recited in claim 1, wherein said apparatus includes a jet-powered propulsion unit operably connected between said heat exchangers and said low pressure regulator means,, whereby gas pressure is received from said exchangers to drive said propulsion unit.

* * * * *